United States Patent [19]

Scott

[11] Patent Number: 5,022,211

[45] Date of Patent: Jun. 11, 1991

[54] CONSTRUCTION SYSTEMS AND ELEMENTS THEREOF

[76] Inventor: Christopher R. Scott, 1039 Silverade, La Tolla, Calif. 92037

[21] Appl. No.: 333,705

[22] Filed: Apr. 3, 1989

Related U.S. Application Data

[62] Division of Ser. No. 16,364, Feb. 19, 1987, Pat. No. 4,817,356.

[51] Int. Cl.[5] ..... E04C 3/30

[52] U.S. Cl. ..... 52/729; 52/566; 52/690

[58] Field of Search ..... 52/586, 285, 286, 270, 52/271, 404, 648, 690

[56] References Cited

U.S. PATENT DOCUMENTS 4,817,356 4/1989 Scott ..... 52/729

*Primary Examiner*—David A. Scherbel
*Assistant Examiner*—Creighton Smith
*Attorney, Agent, or Firm*—Nydegger & Associates

[57] ABSTRACT

Construction elements of predetermined cross-sectional profiles are formed of wood, plastic and/or metal. These construction elements are useful in building construction, preformed panel systems and preformed truss structures. The shapes of the construction elements are also adaptable to a toy construction set.

14 Claims, 10 Drawing Sheets

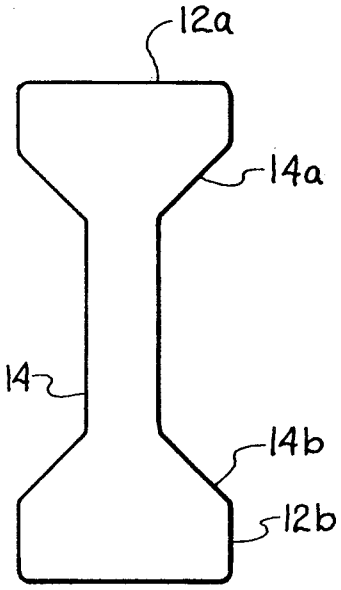
Fig. 4
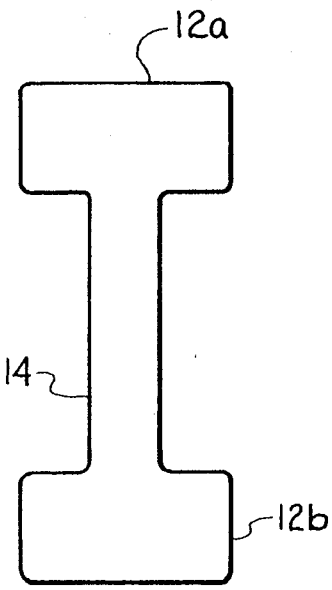
Fig. 3
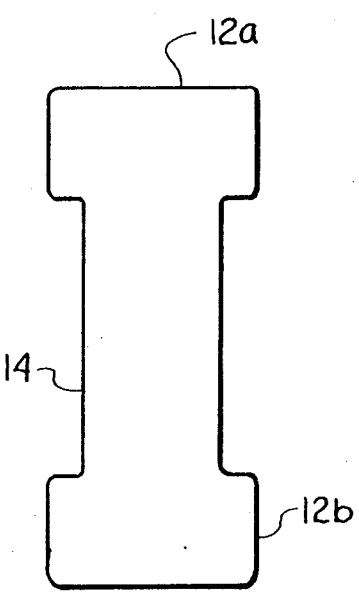
Fig. 2
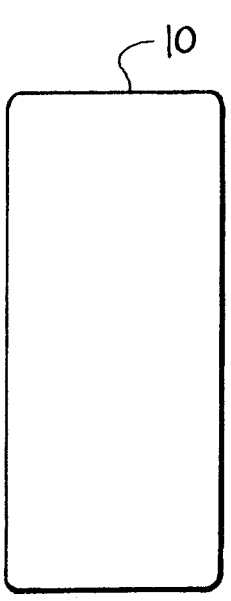
Fig. 1
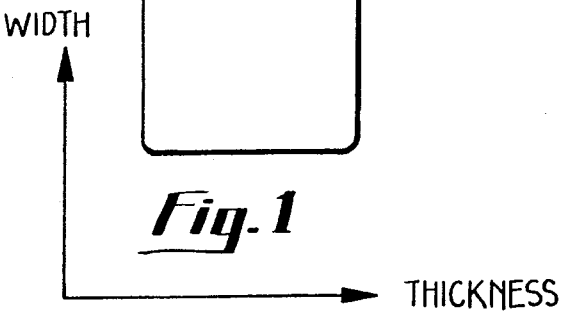

CONSTRUCTION SYSTEMS AND ELEMENTS THEREOF

This is a divisional application of co-pending application Ser. No. 016,364 filed on Feb. 19, 1987, now U.S. Pat. No. 4,817,356.

BACKGROUND OF THE INVENTION

1. Field of the Invention

This invention relates to building construction systems and the elements thereof. In one aspect, this invention relates to wooden profiled lumber for use in the construction and related industries.

2. Description of the Prior Art

Wooden lumber commonly used by the building industry is of a rectangular cross-section. However, for a large number of applications, the actual strength properties of lumber, as a building material, are far greater than structurally required. It would, therefore, be advantageous to design and engineer lumber material to the dimensions required to satisfy the minimum strength requirement. This would not only reduce the cost of material, but also reduce the weight of the lumber thereby lowering the transportation cost. However, the size of the lumber material cannot be reduced below a minimum needed for providing a minimum surface area for nailing or otherwise joining together the various construction elements, or for satisfying other construction needs. For example, the thickness of lumber must be such as to allow adequate surface area for nailing the edges of two adjacent panels onto the edge of the lumber, or its width must be sufficient to provide adequate air or insulation in the spacing between two opposite walls.

SUMMARY OF THE INVENTION

In one embodiment, the present invention provides a wooden construction element having a predetermined length and having a cross-sectional profile comprising a first flange portion having a predetermined thickness and width, a second flange portion having a predetermined thickness and width, the first and second flange portions being parallel to one another relative to their thickness dimension and interconnected by a central integral web portion of predetermined width and essentially smaller thickness than the flange portions.

In another embodiment, the present invention provides a construction element having a predetermined length and having a cross-sectional profile comprising a first flange portion and a second flange portion, the first and second flange portions being of essentially identical predetermined thickness and essentially identical predetermined width. The first and second flange portions are parallel to one another relative to their thickness dimension and interconnected by a central integral web portion of predetermined width and of a thickness about one third of that of the flange portions, the width of the web portion being about equal to the sum of the widths of the flange portions.

In another embodiment, the present invention provides a construction element having a predetermined length and having a cross-sectional profile comprising a first flange portion and a second flange portion, the first and second flange portions being of essentially identical predetermined thickness and essentially identical predetermined width. The first and second flange portions are parallel to one another relative to their thickness dimension and interconnected by a central integral web portion. The central integral web portion comprises a uniform thickness section having a predetermined width and a thickness about one third of that of the flange portions, a first transition section having a width about equal to that of the first flange portion and connection the first flange portion and the uniform thickness section and having a thickness tapering from that of the first flange portion to that of the uniform thickness section, and a second transition section having a width about equal to that of the second flange portion and connecting the second flange portion and the uniform thickness section and having a thickness tapering from that of the second flange portion to that of the uniform thickness section. The predetermined width of the uniform thickness section is about equal to three times the width of one of the flange portions.

In another embodiment, the present invention provides an anchoring system for wall, roof or truss construction utilizing anchor plates and studs of predetermined cross-sectional profile. The anchoring system comprises a flexible anchor track of predetermined length comprising a longitudinally extending channel having a generally U-shape comprising a base of predetermined width and two legs of predetermined height, extending in parallel from the base. A flange extends, on each side of the channel, coextensively longitudinally with the channel and transversely from the free end of the respective leg of the U-shaped channel. A plurality of transverse slots of predetermined thickness, extending width-wise across the entire channel, are formed in the U-shaped channel and spaced longitudinally in a predetermined manner. The anchor track is attachable to an anchor plate in such manner that the open end of the U-shaped channel faces the anchor plate. The anchor system further comprises a plurality of stud sleeves, each comprising a hollow body of predetermined length receivably engageable of the predetermined cross-sectional profile of the studs. At one end of the hollow body, a pair of flanges extend at a predetermined angle to the length of the body in opposite directions, the pair of flanges being adapted to fit into the longitudinal channel of the anchor track, thereby holding the stud sleeve in a respective transverse slot formed in the channel. The anchor track and the stud sleeves cooperate to hold the studs at a predetermined angle to the anchor plate.

In another embodiment, the invention provides a panel building system comprising a plurality of sized panel structures, each panel structure comprising an open frame of predetermined geometric shape of a plurality of longitudinal members having a cross-section comprising two parallel flange portions interconnected by an integral web portion. A thin, relatively rigid sheet of covering material closes at least one face of the open frame and cooperates with the frame to form a dimensionally stable panel structure. The panel building system further comprises a plurality of key block members having a cross-section corresponding to the open cross-section formed between two parallel longitudinal members which abut one another through their two flange portions, the key block members and the panel structures cooperating to link adjacent panel structures along the longitudinal edges thereof; a plurality of filler blocks having a cross-section corresponding to the open cross-section formed between the two flange portions and the web portion on one side of a longitudinal member, the filler blocks and the panel structures cooperating to form flat faces along the longitudinal edges of the panel structures; and a plurality of corner/connecting blocks having a symmetrical generally square cross-section wherein each face of the square has a longitudinal groove corresponding to the open cross-section formed between the two flange portions and the web portion on one side of the longitudinal members, and thereby forming two longitudinal abutment surfaces, separated by the groove, corresponding to the flange portions of the longitudinal members, the corner/connecting blocks, the key block members and the panel structures cooperating to link two or more panel structures along respective longitudinal edges at right angles to one another.

In another embodiment, the invention provides a building system for the construction of room size structures, comprising a plurality of longitudinal members having a cross-section comprising two parallel flange portions interconnected by an integral web portion; and a plurality of transverse members of predetermined length having end portions receivably engageable by the cross-sectional shape of the longitudinal members, the longitudinal members and the transverse members cooperatively engageable to form a structure of parallel spaced apart longitudinal members.

In another embodiment, the invention provides a collapsible building system comprising a plurality of longitudinal members each having a bottom end and a top end and having a cross-section comprising two parallel flange portions interconnected by an integral web portion; a foldable bottom end connector attached to the bottom end of each longitudinal member; a foldable top end connector attached to the top end of each longitudinal member; the bottom end connector and the top end connector cooperating to hold the longitudinal members in a predetermined spaced parallel relation when unfolded and when folded holding said longitudinal members in an accordion-like tightly packed array for ease of transportation.

In another embodiment, the present invention provides a toy construction set comprising a plurality of plastic pieces adapted to be glued together to form generally rectangular structures. The plurality of plastic pieces comprising a predetermined number of longitudinal members having a predetermined length and having a cross-section comprising two parallel flange portions interconnected by an integral web portion; a predetermined number of transverse members of predetermined length having end portions receivably engageable by the cross-sectional shape of the longitudinal members, the longitudinal and transverse members cooperatively engageable to form a grid-like structure of parallel spaced apart longitudinal members; a predetermined number of key block members having a predetermined length and having a cross-section corresponding to the open cross-section formed between the two flange portions and the web portion on one side of the longitudinal members, the filler blocks and the longitudinal members cooperatively engageable to form flat faces along the longitudinal edge of the longitudinal members; and a predetermined number of corner/connecting blocks having a predetermined length and a symmetrical generally square cross-section wherein each face of the square has a longitudinal groove corresponding to the open cross-section formed between the two flange portions and the web portion on one side of the longitudinal members, thereby forming two longitudinal abutment surfaces, separated by the groove, corresponding to the flange portions of the longitudinal members, the corner/connecting blocks, the key block members and the longitudinal members cooperatively engageable to link two or more longitudinal members at right angles to one another.

In a further embodiment, the present invention provides a corner/connecting block having a predetermined length and having a cross-sectional profile comprising a symmetrical generally square cross-section, each face of said square having a longitudinal grooved formed therein, said groove being of symmetrical trapezoidal shape wherein the non-parallel faces of said symmetrical trapezoid open outwardly from the central portion of said square.

BRIEF DESCRIPTION OF THE DRAWINGS

FIG. 1 illustrates the cross-sectional shape of conventional wooden lumber.

FIGS. 2–5 illustrate some possible cross-sectional shapes of construction elements in accordance with the present invention.

DETAILED DESCRIPTION OF THE PREFERRED EMBODIMENTS

Figure 5:
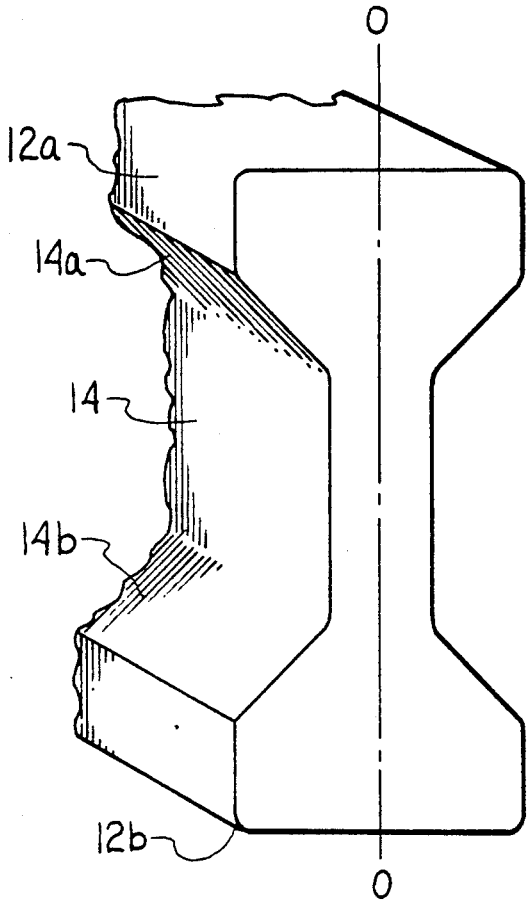

Referring to FIGS. 1-4, there is shown in the extreme left view (FIG. 1) a cross-section of a conventional 2"×4" wooden lumber or stud 10 as commonly used in the building industry, particularly for constructing residential dwellings. The three right-hand views (FIGS. 2-4) show differing cross-sectional views of wooden construction elements which may be manufactured by making rectangular or trapezoidal grooves in the walls of the conventional stud of FIG. 1. The dimensions given in FIG. 1 are the approximate dimensions of a conventional 2"×4" wooden lumber or stud and the dimensions given in FIGS. 2-4 are the approximate dimensions of the grooves made in the walls of the conventional wooden lumber or stud. The thickness and width directions are shown by the scale in the lower left-hand corner of FIG. 1.

The wooden construction elements have a cross-sectional profile comprising a first flange portion 12A having a predetermined thickness and width, a second flange portion 12B having a predetermined thickness and width, the first and second flange portions are parallel to one another relative to their thickness dimension and interconnected by a central integral web portion 14 of predetermined width and essentially smaller thickness than the flange portions.

The shaping of the wooden construction element is preferably performed by forming a groove in each wall of a conventional wooden lumber or stud, thereby removing a total of between about 15% and 50% of the material of the original cross-section. The actual width of the groove is preferably such that the material removed is about equal to the sum of the width of the material left in the two flange portions 12A and 12B. The actual thickness of the web portion 14 of the wooden construction element would depend on the end use of the product, but is preferably not less than one third of the thickness of the flange portion 12A or 12B. These proportions also offer an ideal shape for nesting as will be explained hereinafter.

The web material can be removed by routing, splitting or with conventional chip and saw type machinery, preferably by using a chipping machine having suitably shaped chipper heads. The material so-removed may advantageously be used to make chips for the pulping industry, providing material for composite wood products such as particle or wafer board, for making molding material, or used as an energy source when burnt as fuel.

In FIG. 2, the wood material removed, by making a rectangular groove in the wall of a conventional wooden lumber or stud, is about 20% of the original lumber material, thus reducing the weight thereof by 20%-30% depending on the density of the wood species used, and, consequently, the transportation cost by an equal amount.

In FIG. 3, the wood material removed, by making a deeper groove in the wall of a conventional wooden lumber or stud, is about equal to 40% of the original lumber material, thus reducing the weight thereof by 40%-50%.

FIG. 4 shows a dog-bone shaped cross-section producted by making a trapezoidal groove in the wall portions of a conventional wooden lumber or stud. In this embodiment, the central web portion comprises a uniform thickness section 14' having a thickness less than that of the flange portions 12A or 12B, a first transition section 14A, connecting the first flange portion 12A and the uniform thickness section 14', having a thickness tapering from that of the first flange portion to that of the uniform thickness section, and a second transition section 14B, connecting the second flange portion 12B and the uniform thickness section 14', having a thickness tapering from that of the second flange portion to that of the uniform thickness section. This configuration provides about the same amount of wood reduction as in FIG. 3, but reduces the possibility of splitting the edges of the wooden construction element when nailing panels to the edges of the construction element.

FIG. 5 shows the preferred shape and dimensions to provide the best compromise between strength and weight for a wooden construction element, which is aesthetically pleasing and suited for shipping and as a building element.

Figure 6:
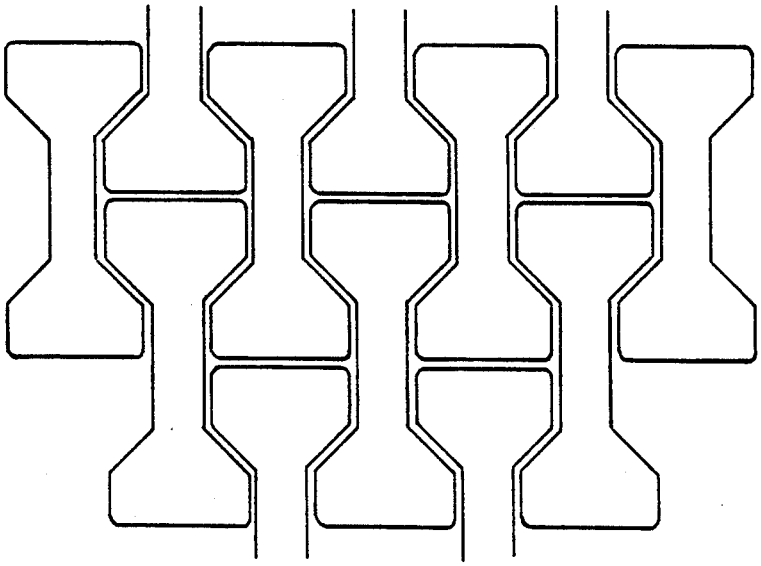
FIG. 6 shows interlocking of construction elements, in accordance with the present invention, for shipping.

As previously noted, the width of the groove forming the web portion 14 of the wooden construction elements of FIGS. 2-5 is preferably about equal to the width of the material left in the two flange portions, 12A and 12B. This leaves sufficient material for adequate nailing or otherwise securing panels or other structural elements to the edges of the construction elements. This particular shape is also designed to allow interlocking of the construction elements for shipping in such a way that they nest together like a jigsaw puzzle to optimize volume savings, as shown in FIG. 6. This shape also avoids the use of "sticking" (to prevent lumber slippage over itself) when shipping the lumber. With respect to the preferred "dog bone" shape of FIGS. 4 and 5, the oblique surfaces 14" allow easier nailing for maximum strength, i.e. a nail perpendicular to this surface can be driven through the wood at an angle to center line 0—0, whereas a conventional 2"×4" would require that the nail be held at an angle to the wood surface (it being much easier to drive a nail perpendicular to the surface than at an angle to the surface).

The actual thickness of the web portion 14 of the construction elements depends on the strength properties required for the end use of the product. For a large number of applications, such thickness would be about a third of the original thickness of the original lumber or stud, i.e. the thickness of the flange portions 12A or 12B, such as shown in FIGS. 3, 4 and 5 of the drawings.

It has been found that the above shaping of conventional wooden lumber of studs into construction elements reduces the lumber strength properties but, as previously mentioned, the strength properties of lumber are far greater than structurally required in many applications, and the cross-sectional area of the lumber can be easily reduced by a substantial amount for these applications. This excess wood material removed to form the construction element provides additional usable material from a given volume of wood.

There is a shortage in North America of wood chips suitable for use in pulp and paper mills. Thus, the construction elements of this invention may yield a considerable volume of pulp wood chips without a commensurate reduction in the quantity of lumber available for use in the building construction industry.

Other advantages of the wooden construction elements in accordance with the invention are:

(a) the "dog bone" shape of the preferred wooden construction elements reduces the stress points in the wood when drying thereby reducing the splitting and checking that takes place during the drying process;

(b) the grooves forming the web portion of the wooden construction elements permit improved flow of air in the kilns resulting in more rapid and efficient drying of wood; and (c) the grooves forming the web portion of the wooden construction element also provide extra surface area to simplify and improve the holding power of the fasteners used.

Although the wooden construction elements have been disclosed with reference to the cross-sectional profiles illustrated in FIGS. 2–5, it is to be understood that the shape of the grooves forming the web portion of the wooden construction elements may be varied according to end use and these disclosed shapes are not limiting on the invention.

In this regard, it should be borne in mind that the first and second flange portions are preferably of identical shape and size. Additionally, while the wooden construction elements have been disclosed in the context of a 2"×4" configuration, the particular profiles are equally applicable to larger stock, e.g., 2"×6", 2"×8", 4"×4", etc. and smaller stock, e.g., 1"×1", 1"×2", etc.

The wooden construction elements can be supplied in standard lengths utilized in the building industry, e.g., 8', 10', 12', etc., but can also be formed in lesser or greater lengths as dictated by job requirements.

With respect to the wooden construction elements, it should also be noted that while these have been disclosed as being prepared from sawn lumber, e.g., 2"×4" stock, the term "wooden" extends to wood products such as glued wooden pieces forming the appropriate cross-sectional profile, e.g., the flange portions 12A and 12B are glued to the ends of a web portion 14 to form the desired cross-sectional profile, etc. and oriented strand or wafer board (known in themselves in the art as a mixture of reconstituted wood fibers (cellulose fibers) and a glue matrix which may additionally contain wood chips, particles or strands) which have been extruded in the desired cross-sectional profile.

In another embodiment, the present invention provides construction elements made of, in addition to wood, materials of construction such as plastic, preferably structural plastics including foams; metal such as sheet metal or aluminum, preferably extruded aluminum; and composites such as a plastic foam formed in the appropriate cross-sectional profile and contained in a sheet metal sheath of corresponding cross-sectional profile (the sheath being sealed by welding, soldering or gluing along a longitudinal seam or seams).

These construction elements have a cross-sectional profile (as shown in FIG. 3) comprising a first flange portion 12A and a second flange portion 12B, the first and second flange portions being of essentially identical predetermined thickness and essentially identical predetermined width. The first and second flange portions, 12A and 12B, are parallel to one another relative to their thickness dimension and interconnected by a central integral web portion 14 of predetermined width and of a thickness about one third of that of the flange portions, 12A and 12B. The width of the web portion 14 is about equal to the sum of the widths of the flange portions.

Preferably, these construction elements have a cross-sectional profile (as shown in FIG. 4) comprising a first flange portion 12A and a second flange portion 12B, the first and second flange portions are of essentially identical predetermined thickness and essentially identical predetermined width. The first and second flange portions are parallel to one another relative to their thickness dimension and interconnected by a central integral web portion comprising a uniform thickness section 14' having a predetermined width and a thickness about one third of that of the flange portions, 12A or 12B; a first transition section 14A having a width about equal to that of the first flange portion 12A and connecting the first flange portion 12 A and the uniform thickness section 14' and having a thickness tapering from that of the first flange portion 12A to that of the uniform thickness section 14'; and a second transition section 14B having a width about equal to that of the second flange portion 12B and connecting the second flange portion 12B and the uniform thickness section 14' and having a thickness tapering from that of the second flange portion 12B to that of the uniform thickness section 14'. The predetermined width of the uniform thickness section 14' is about equal to three times the width of one of the flange portions, 12A or 12B.

These construction elements are suitably prepared in cross-sectional profile corresponding to an overal 2"×4" configuration, but are equally applicable to larger or smaller stock, e.g., 2"×6" or 2"×8", 4"×4", 1"×1", 1"×2", etc. These construction elements can be supplied in standard lengths utilized in the building industry, e.g., 8', 10', 12', etc., but can also be formed in lesser or greater lengths as dictated by job requirements.

These construction elements are suitably formed by bending, molding or casting, especially in the case of plastics, or by extrusion, especially in the case of metals, although the particular fabrication techniques can be used for any of the types of materials.

Additionally, the aforedescribed construction elements can be utilized in the building systems described hereinafter.

In another embodiment, the present invention provides an anchoring system for stud wall construction utilizing anchor plates and studs of predetermined cross-sectional profile. As shown in FIGS. 8–11, the system comprises a flexible anchor track generally indicated at 30 comprising a central longitudinally extending channel 32 having a generally U-shape formed from a base 34 of predetermined width and two legs of predetermined height extending in parallel from the base 34. A flange 38, on each side of the channel 32, extends coextensively longitudinally with the channel 32 and transversely from the free ends of the respective legs 36 of the U-shaped channel 32. A plurality of transverse slots 40 of predetermined thickness extend width-wise across the entire channel 32, and are spaced longitudinally in a prdetermined manner. The anchor track 30 is attachable to an anchor plate 42, e.g., a conventional 2"×4" wooden stud, in such manner that the open end of the U-shaped channel 32 faces the anchor plate 42.

Figure 12:
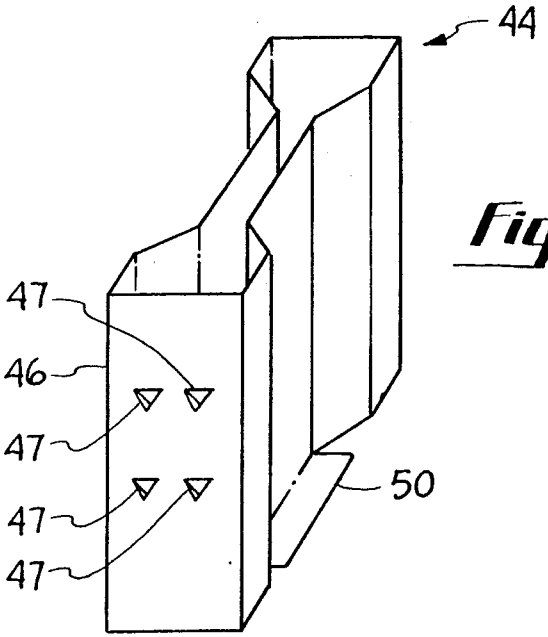
FIG. 12 shows a perspective view of a stud sleeve in accordance with the present invention.
Figure 13:
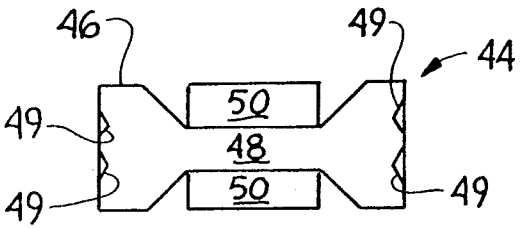
FIG. 13, shows a top view of the stud sleeve of FIG. 12.

The anchor system further comprises a plurality of stud sleeves, generally indicated as 44 in FIGS. 12 and 13, which comprise a hollow body 46 of predetermined length receivably engageable of the end of a stud. To this effect the cross-section 48 of the hollow body 46 corresponds to the predetermined cross-sectional profile of the stud (as shown in FIGS. 12 and 13 the cross-section of the hollow body corresponds to the dog-bone shape of a construction element as shown in FIG. 4). A pair of flanges 50 extends perpendicular to the length of the body in opposite directions along the wide side of the hollow body 46. This pair of flanges 50 is adapted to fit into the longitudinal channel 32 of the anchor track 30, thereby holding the stud sleeve in a respective transverse slot 40 formed in the channel 32.

Figure 11:
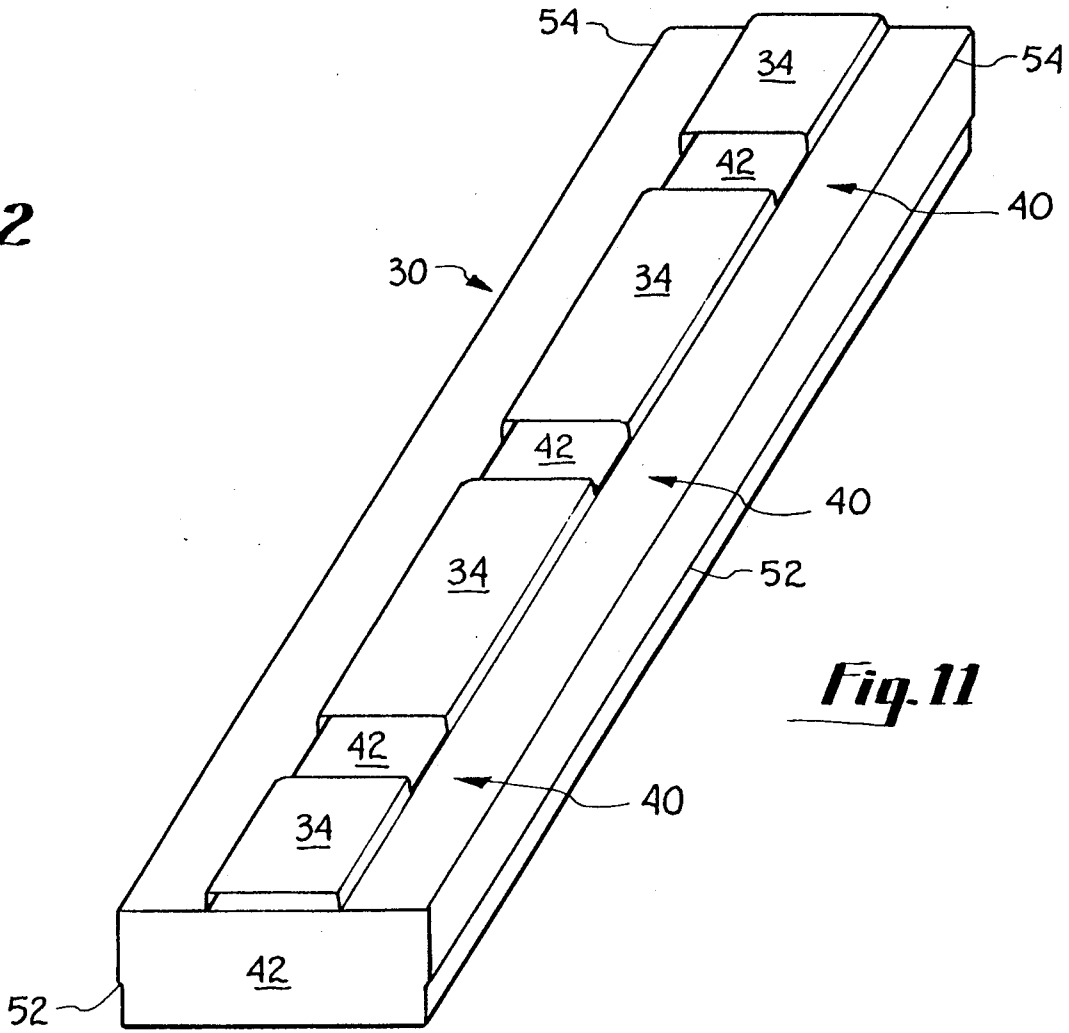
FIG. 11 shows a perspective view of the anchor track of FIG. 8 in place on an anchor plate.

In the case of conventional stud wall construction, using a 2"×4" configuration of the dog-bone profile of FIG. 4, the central channel 34 of the anchor track is about 1½" wide and the legs 36 of the channel are about ⅛" high. The flanges 38 extend about 2" transversely on each side and run longitudinally coextensively with the channel 34. Midway between the edges 52 of the flanges 38 and the central channel 34, each of the flanges 38 is scored, shown as dotted line 54, to allow the outer portion of the flange to be bent around an anchor plate 42, as best shown in FIG. 11. (Alternatively, a series of holes could be punched or drilled in the flanges for this purpose.) The transverse slots 40 are longitudinally spaced about 4" center-to-center and are about ¾" wide. The slots can be marked (not shown) or color-coded (not shown) to show 16", 24" and/or 36" spacings.

Figure 29:
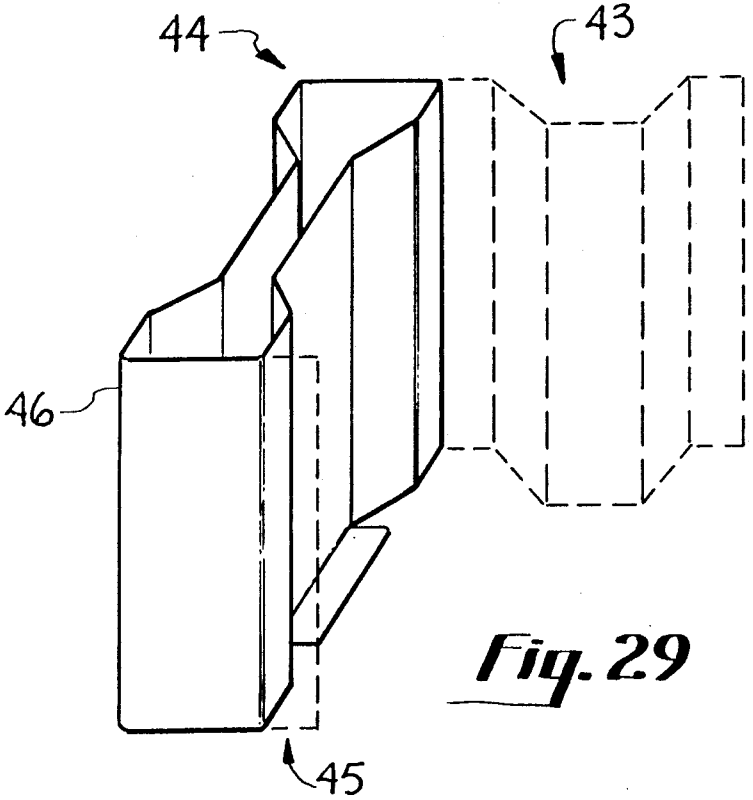
FIG. 29 shows a perspective view of another embodiment of the stud sleeve in accordance with the present invention.

After the anchor track 30 has been bent around the anchor plate 42 and affixed thereto by conventional means of attachment, e.g., gluing or nailing, one of the stud sleeve flanges 50 is inserted into the channel 34, at one side of a transverse slot 40, the center of the stud sleeve is compressed and the other flange 50 is inserted into the channel 34 on the other side of the transverse slot. This process is repeated until sufficient stud sleeves 44 are inserted in the track 30 for the desired purpose. Studs are then slipped into the hollow body 46 of the sleeves 44 and affixed therein by conventional means of attachment, e.g., nailing or gluing. Alternatively, the stud sleeve 44 may have barbs formed in the hollow body 46 which permit a stud to be inserted into the stud sleeve but prevent the stud from being removed. As shown in FIGS. 12 and 13, a plurality of V-cuts 47 may be made in the hollow body 46 with the apex of the V pointing toward the flange 50. The triangular sections 49 defined by the V-cuts 47 are bent inwards and form barbs which will engage a stud received within the hollow body 46. In another alternative, shown in FIG. 29, the hollow body 46 of the stud sleeve 44 can be formed as a foldable member. In this configuration, one side 43 of the hollow body 46 can be unfolded to the position shown in dotted lines, along with an overlap strip 45, to open the hollow body 46 for receipt of a stud. Overlap strip 45 is then folded over the stud and overlap strip. The stud sleeve can be sealed by gluing or nailing, e.g., a nail driven through portion 43' of side 43 and overlap strip 45 into the stud closes the hollow body 46 and attachs the stud sleeve to the stud. The anchor track 30 and the stud sleeves 44 thereby cooperate to hold the studs in a predetermined parallel spaced apart relation perpendicular to the anchor plate 42.

The anchor track 30 may be formed of plastic or metal and is preferably fabricated in long continuous strips which may be rolled up for shipment.

The stud sleeves 44 are also formed of plastic or metal, provided they exhibit sufficient flexibility to allow their center sections to be compressed for insertion of the flanges 50 into the channel 34 of the track 30.

Figure 14:
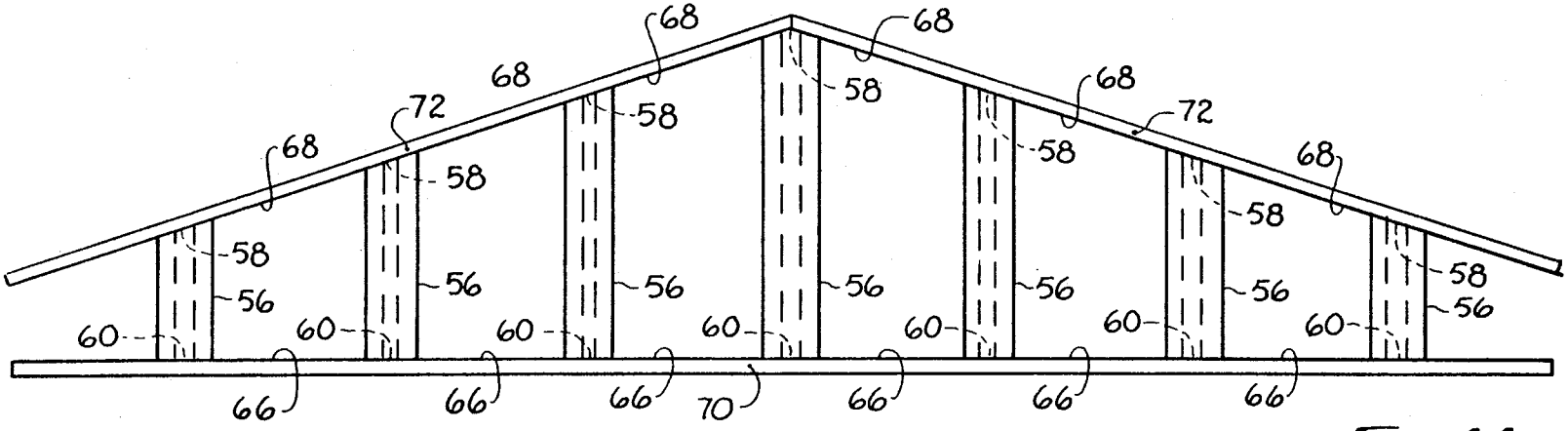
FIG. 14 shows a truss building system in accordance with the present invention in fully expanded form.
Figure 15:
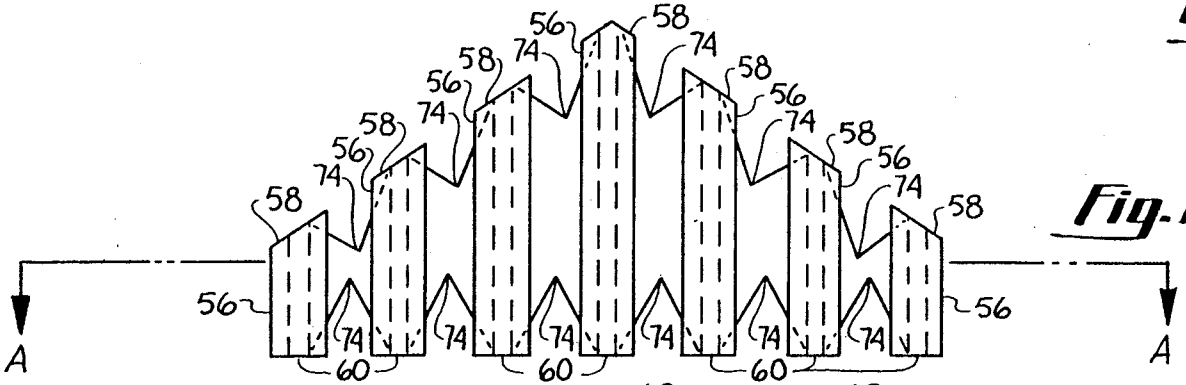
FIG. 15 shows the truss building system of FIG. 14 in partially expanded form.
Figure 16:
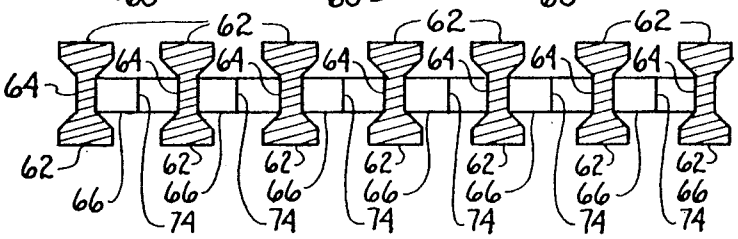
FIG. 16 is a sectional view of the partially expanded truss building system taken along line A—A of FIG. 15.

In another embodiment, the invention comprises a truss building system as shown in FIGS. 14–16. The system comprises a plurality of longitudinal members 56, each having a top end 58 and a bottom end 60. The longitudinal members 56, as best shown in FIG. 16, have a cross-section comprising two parallel flange portions 62 interconnected by an integral web portion 64. A flexible bottom end connector 66 is attached to the bottom end 60 of each longitudinal member 56. A flexible top end connector 68 is attached to the top end 58 of each longitudinal member 56.

The bottom end connector 66 and the top end connector 68 cooperate to hold the longitudinal members 56 in a predetermined spaced parallel relation when unfolded as shown in FIG. 14. The bottom ends 60 of the longitudinal members 56 may then be affixed, e.g., by nailing, to a bottom sill plate 70, and likewise the top ends 58 may then be affixed in a similar manner to a top sill plate(s) 72. As shown in FIG. 14, the longitudinal members 56 may be of predetermined gradated length to form a conventional truss structure. Alternatively, the longitudinal members may all be of the same length to form a conventional wall structure.

When folded (see FIG. 15 for a partially folded configuration), the bottom and top connectors allow the longitudinal members to be collapsed accordion-style to a tightly packed array for ease of transportion. To facilitate folding, each of the bottom and top connectors, which are preferably formed of metal strips, are provided with a plurality of crease lines 74 for easy controlled collapse of the structure for transportation.

Alternatively, the previously described anchoring system comprising the flexible anchor track and stud sleeves can be used as the top end and/or bottom end connector. In this embodiment, each of the bottom end and top end connectors may comprise a flexible anchor track of predetermined length having a central longitudinally extending channel having a generally U-shape comprising a base of predetermined width and two legs of predetermined height extending in parallel from the base. A flange, on each side of the channel, extends coextensively longitudinally with the channel and extending transversely from the free ends of the respective legs of the U-shaped channel. A plurality of transverse slots of predetermined thickness, extending width-wise across the entire channel, are formed in the U-shaped channel and spaced longitudinally in a predetermined manner. A plurality of stud sleeves, each comprising a hollow body of predetermined length, receivingly engage the cross-sectional profile of a respective longitudinal member at a respective end thereof. A pair of flanges extend at a predetermined angle to the length of the hollow body in opposite directions. The pair of flanges fit into the longitudinal channel of the anchor track and hold the stud sleeve in a respective transverse slot.

In another embodiment of the invention, a panel building system is provided. In this system, a plurality of sized panel structures, generally indicated at 21, are provided which can be assembled into room size units. One such panel structure, illustrated in FIG. 24, comprises an open generally rectangular grid work of a plurality of longitudinal members 20 having a cross-section comprising two parallel flange portions interconnected by an integral web portion and a plurality of transverse members 22 of predetermined length having end portions receivably engageable by the cross-sectional shape of the longitudinal members 20. Transverse members 24 of different standardized lengths may be provided to fix precisely the spacing of window openings 25 or doors (not shown) according to building industry regulations. The longitudinal members 20 and the transverse members, 22 and 24, cooperate to form a structure of parallel spaced apart longitudinal members. A thin relatively rigid sheet of covering materal 27 is affixed to one side of the structure and cooperates with the grid works to form a dimensionally stable panel structure. A conventional sill plate 29 may be provided for additional strength.

The thin relatively rigid sheet of covering material can be formed of materials conventional in the building industry for such purposes, e.g., solid wood plywood, gypsum board, wafer board, etc. Typically, the sheet will be $\frac{1}{8}''$–$\frac{5}{8}''$ thick depending on the particular material utilized.

Panels can be formed in standardized sizes for building construction, e.g., $1'\times8'$, $2'\times8'$, $4'\times8'$ and $8'\times8'$, as well as in other sizes (larger or smaller) for particular applications. The panels can also be formed in various geometric shapes such as the conventional rectangles for wall construction or special shapes for particular uses e.g., triangles for construction of gable ends.

In a particular preferred embodiment of the panel system (as shown in FIGS. 25–28), each panel structure comprises an open frame of predetermined geometric shape of a plurality of longitudinal members having a cross-section comprising two parallel flange portions interconnected by an integral web portion wherein both faces of the open frame are closed by respective thin relative rigid sheets of covering material to form a hollow core within the panel structure.

Figure 26:
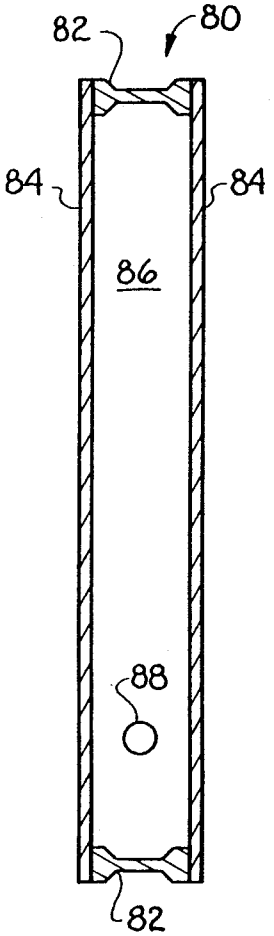
FIG. 26 is a sectional view of the panel structure of FIG. 25 taken along line B—B of FIG. 25.
Figure 25:
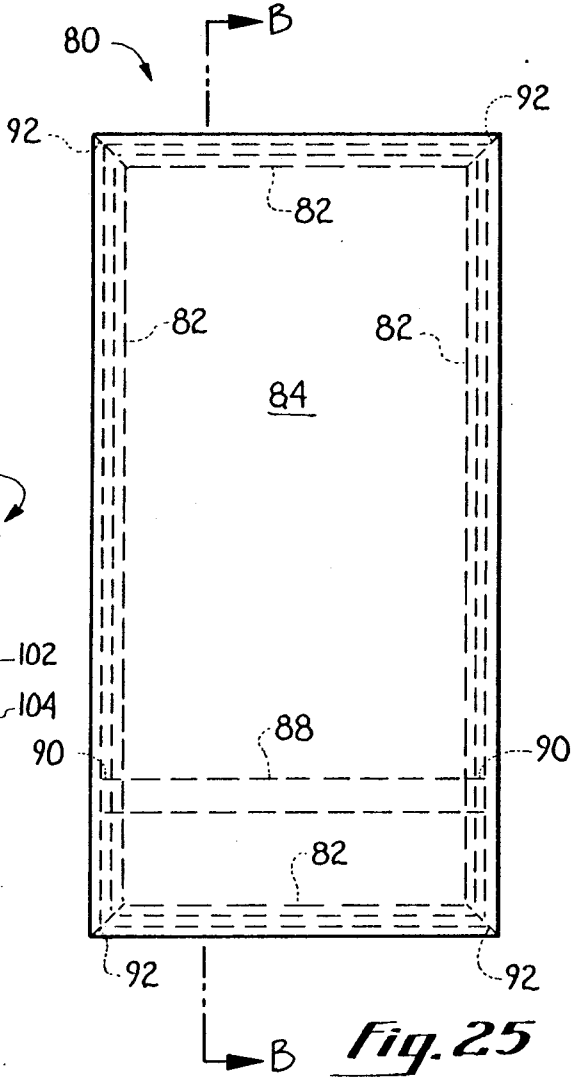
FIG. 25 is a plan view of a panel structure in accordance with the present invention.

FIGS. 25 and 26 illustrate a rectangular panel structure, generally indicated at 80, comprised of an open frame of longitudinal members 82 having a cross-section comprising two parallel flange portions interconnected by an integral web portion. A thin, relatively rigid sheet of covering material 84, as previously described, closes each face of the frame to form a hollow core 85 within the panel structure 80. A conduits 88 parallel to an edge of the panel structure passes through the panel structure 80 within the hollow core 86. The conduit at its ends is connected to respective apertures 90 in the frame of the panel structure. The conduit can interconnect with corresponding conduits (not shown) in adjacent panel structures (not shown). The conduit (or a plurality of such conduits in a given panel structure) can be used for electrical supply or plumbing supply or for sprinkler systems. Typically, the conduit or conduits will be located in an area from the center of the panel to within about 8" of an edge of the panel. The open frame of the panel structure can be assembled by any conventional technique, e.g., utilizing mitered ends 92 and gluing and/or nailing. The covering material 84 can be attached to the frame by any conventional technique, e.g., gluing, nailing and/or stapling.

Figure 28:
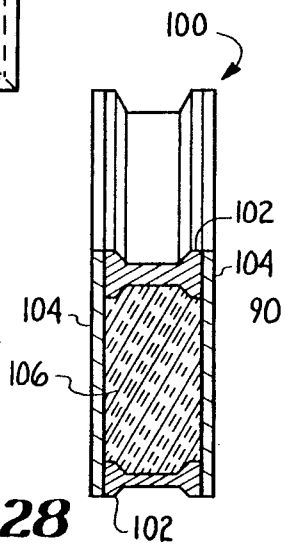
FIG. 28 is a sectional view of the panel structure of FIG. 27 taken along line C—C of FIG. 27.
Figure 27:
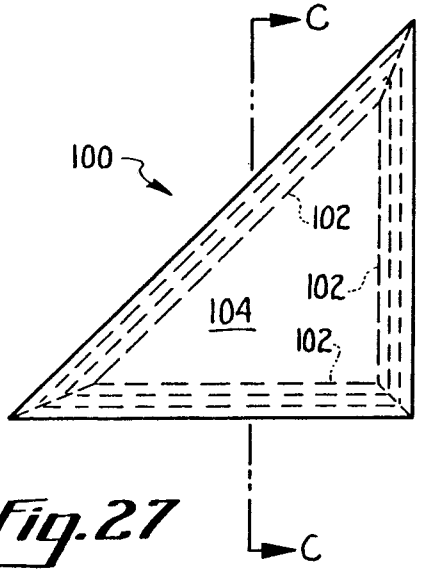
FIG. 27 is a plan view of a triangular (gable) panel structure in accordance with the present invention.

FIGS. 27 and 28 illustrate a triangular panel structure, generally indicated at 100, suitable for use in the construction of a gable end of a house. The panel structure 100 comprises an open frame of longitudinal members 102 having a cross-section comprising two parallel flange portions interconnected by an integral web portion. A thin, relatively rigid sheet of covering material 104, as previously described, closes each face of the frame to form a hollow core 106, which may as illustrated be filled with thermal insulating material, e.g., fiberglass, polystyrene foam, polyurethane foam, etc. Alternatively, the hollow core 106 can be filled with a material providing additional strength and/or rigidity to the panel such as a corrugated material, e.g., cardboard, or a honeycomb structure. As with the previously described panel structure 80 (FIGS. 25 and 26), the open frame can be assembled by conventional techniques and covering material can be fastened to the frame by conventional means.

Figure 30:
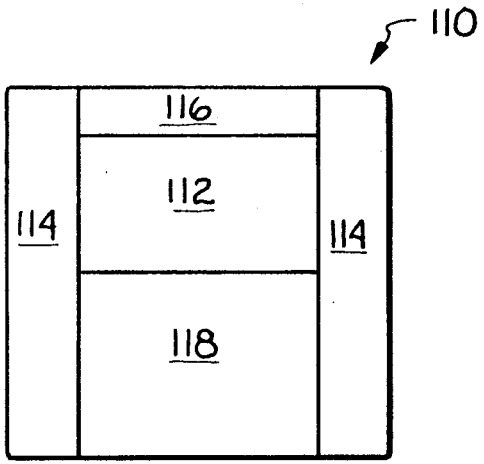
FIG. 30 is a plan view of a panel assembly in accordance with the present invention.
Figure 31:
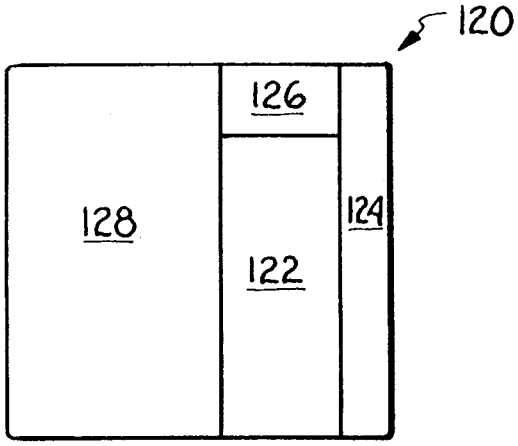
FIG. 31 is a plan view of another panel assembly in accordance with the present invention.

As shown in FIGS. 30 and 31, the panel structures of the present invention, supplied in various standardized sizes, can be assembled to form building structures, e.g., walls or wall portions. FIG. 30 shows an $8'\times8'$ wall portion, generally indicated at 110, having a $3'\times5'$ opening for a window 112 comprised of two panels 114 of $1\frac{1}{2}'\times8'$ size, one panel 116 of $1'\times5'$ size and one panel 118 of $4'\times5'$ size. FIG. 31 shows an $8'\times8'$ wall portion, generally indicated at 120, having a $2\frac{1}{2}'\times6\frac{1}{2}'$ opening for a door 122 comprised of a $1'\times8'$ panel 124, a $1\frac{1}{2}'\times2\frac{1}{2}'$ panel 126 and a $4\frac{1}{2}'\times8'$ panel 128. Other conventional building structures can be formed in a similar manner.

Additional structural members may be provided to allow ready interlock of the panel system and/or to facilitate conventional construction operations. These structural members, as well as the previously disclosed longitudinal members and transverse members, can be formed in the same manner and of the same materials as the previously described construction elements.

Figure 17:
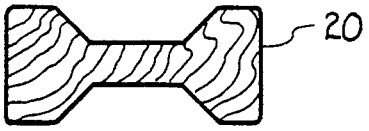
FIG. 17 is a crosssectional profile of a longitudinal member in accordance with the present invention.
Figure 24:
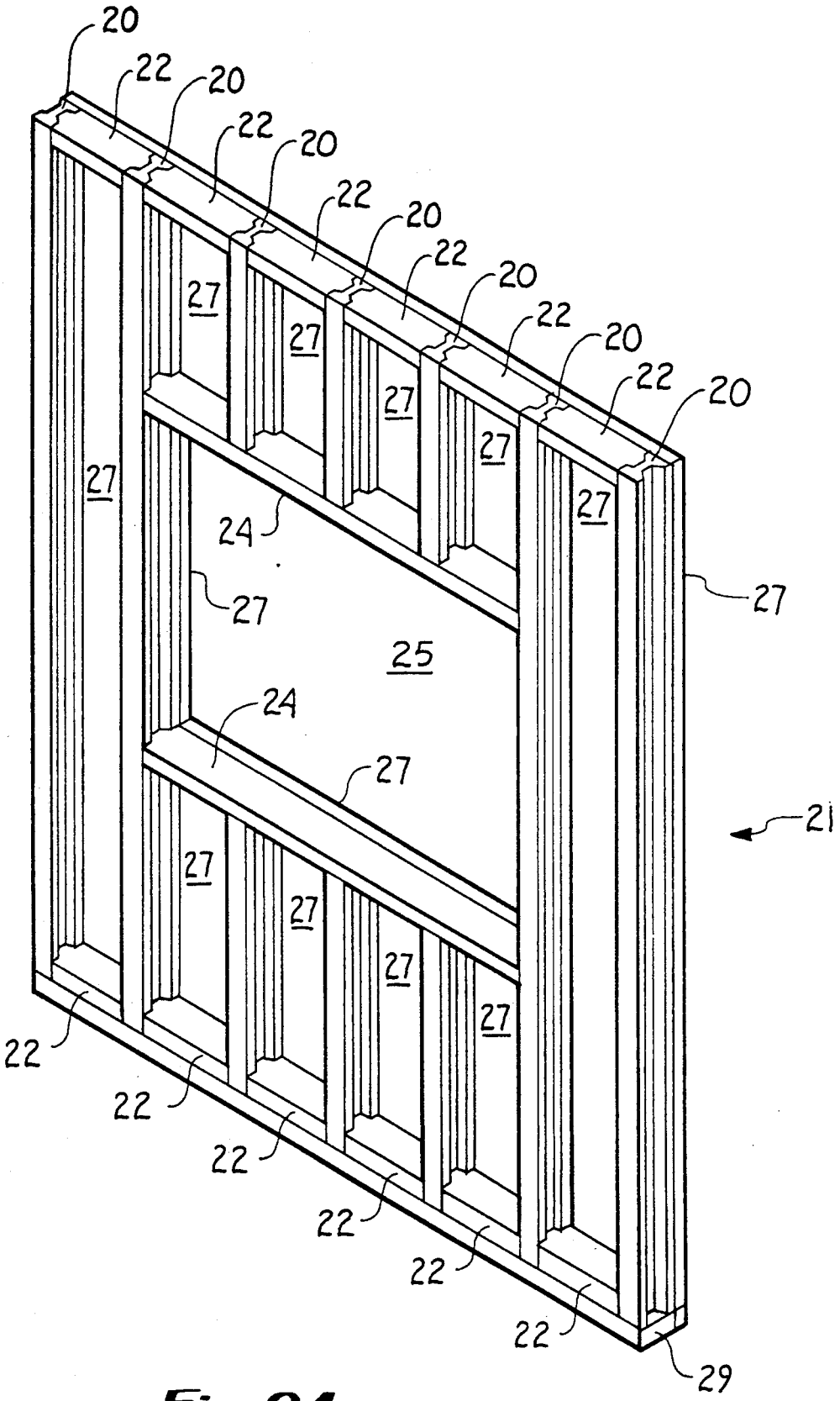
FIG. 24 is a perspective view of a structure in accordance with the present invention.

FIG. 17 shows the cross-sectional profile of one of the longitudinal members 20 (see FIG. 24).

Figure 18:
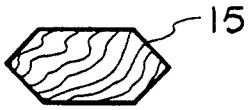
FIG. 18 is a cross-sectional profile of a key block member in accordance with the present invention.
Figure 23:
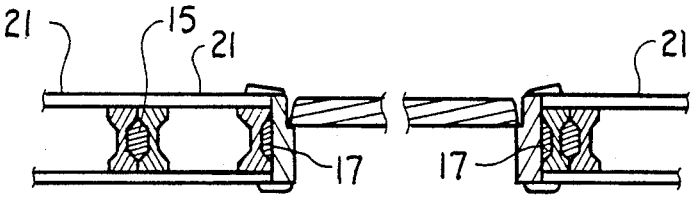
FIG. 23 is a sectional view of a door jamb assembly in accordance with the present invention.

FIG. 18 shows the cross-sectional profile of a key block member 15 which corresponds to the open cross-section formed between two parallel longitudinal members 20 which abut one another through their flange portions 20' (see FIG. 17). Such key block members 15 cooperate with panel structures 21 to link adjacent panel structures along the longitudinal edges thereof, as shown in FIG. 23.

Figure 19:
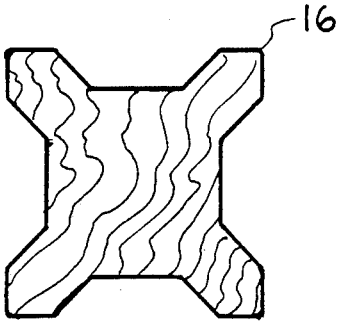
FIG. 19 is a crosssectional profile of a corner/connector block in accordance with the present invention.
Figure 22:
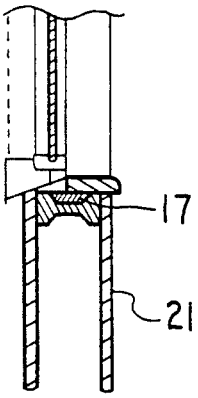
FIG. 22 is a sectional view of a corner assembly in accordance with the present invention.
Figure 22:
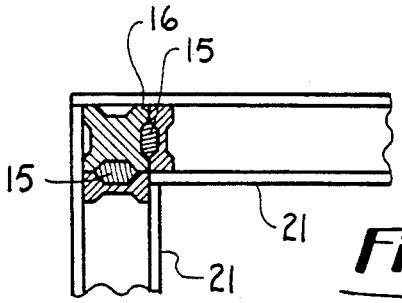

FIG. 19 shows the cross-sectional profile of a corner/connecting block 16 which is a symmetrical generally square cross-section wherein each face of the square has a longitudinal groove 16' corresponding to the groove 20' formed between two flange portions 20' and the web portion 20''' (see FIG. 17) on one side of the aforedescribed longitudinal members 20. These grooves 16' form two longitudinal abutment surfaces 16'', on each face of the square, corresponding to the flange portions 20' of the longitudinal members 20. The corner/connecting blocks 16, the key block members 15 and the panel structures 21 cooperate to link two or more panel structures along respective longitudinal edges at right angles to one another as shown in FIG. 22.

Additionally, the corner/connecting blocks can be utilized in its own right as a newel post or a fence post due to its aesthetically pleasing. For such uses, the corner/connecting block can be formed in a $6''\times6''$ configuration or larger, in addition to the $4''\times4''$ configuration.

Figure 21:
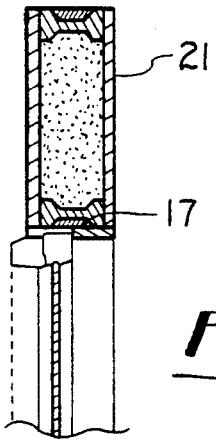
FIG. 21 is a sectional view of a window jamb assembly in accordance with the present invention.
Figure 20:
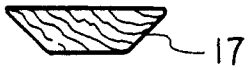
FIG. 20 is a cross-sectional profile of a filler block in accordance with the present invention.

FIG. 20 shows the cross-sectional profile of a filler block 17 which corresponds to the open cross-section formed between the two flange portions 20' and the web portion 20''' on one side of a longitudinal member 20 (see FIG. 17). The filler blocks 17 and the panel structures cooperate to form flat faces along the longitudinal edges of the panel structures 21, as shown in FIG. 21 for a window jamb assembly and in FIG. 23 for a door jamb assembly.

Figure 7:
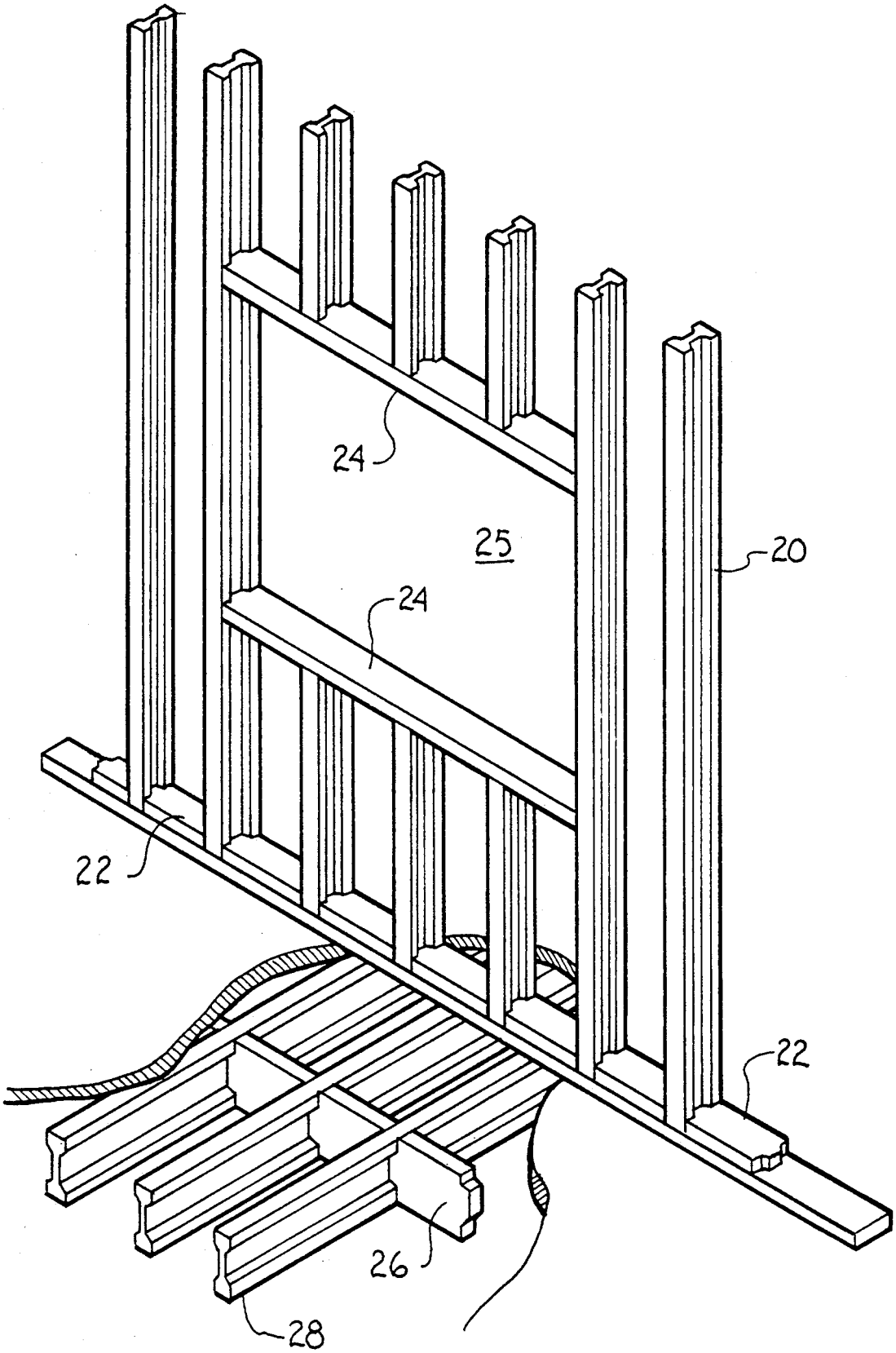
FIG. 7 illustrates a simplified use of the construction elements in accordance with the present invention in a building concept based on the utilization of precut transverse members having end portions which are affixed in the grooves of the construction elements between adjacent elements.
Figure 8:
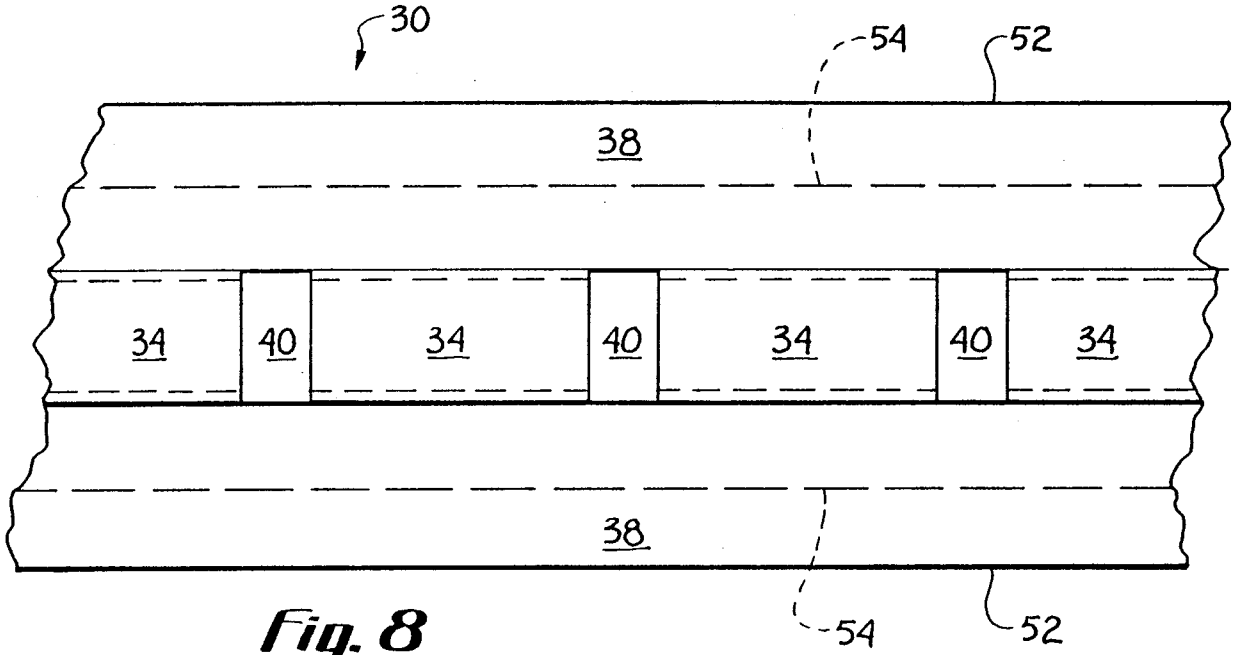
FIG. 8 shows a top view of an anchor track in accordance with the present invention.
Figure 10:
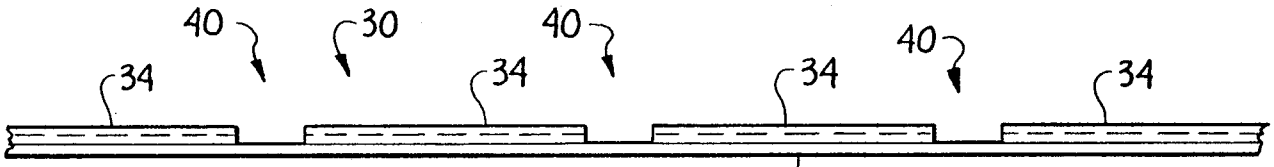
FIG. 10 shows a side view of the anchor track of FIG. 8.
Figure 9:
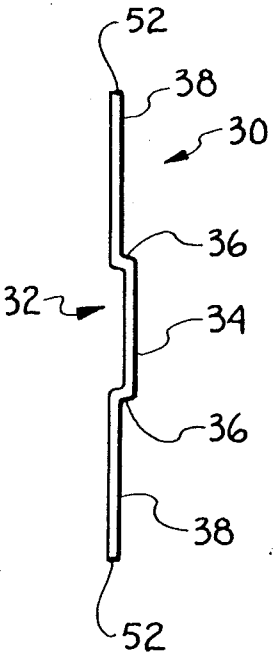
FIG. 9 shows an end view of the anchor track of FIG. 8.

In another embodiment, the invention provides a building system for the construction of room size structures. As shown in FIG. 7, the system comprises a plurality of longitudinal members 20 having a cross-section comprising two parallel flange portions interconnected by an integral web portion and a plurality of transverse members 22 of predetermined length having end portions receivably engageable by the cross-sectional shape of the longitudinal members 20, the longitudinal members 20 and the transverse members 22 cooperatively engageable to form a structure of parallel spaced apart longitudinal members. FIG. 7 shows a building section constructed using cut-to-length longitudinal member 20 of uniform cross-sectional shape, which shape is selected so that individual component parts may be interlocked together with a minimum of nailing and without requiring precise measurement or cutting as is the case with conventional building materials. This results in reduced on-site waste and very accurate framing. As shown in FIG. 7, a wall section may be constructed, in a 2"×4" format, with longitudinal member 20 held in spaced parallel relationship by pre-cut transverse members 22 having their ends shaped to fit into the grooves of the longitudinal members 20, thereby reducing nailing requirements to a minimum. The transverse members 22 are simply placed between adjacent longitudinal members 20 thereby fixing the distance between the studs precisely in accordance with building industry regulations. As also shown in FIG. 7, transverse members 24 of different standardized lengths may be provided to fix precisely the spacing of window openings 25 or door openings (not shown), according to building industry regulations. Similarly, pre-cut transverse members 26 may be provided for fixing the spacing of longitudinal members 28, in a 2"×10" format, as floor beams or joists. The system permits unskilled workers to assemble the framework for structures strongly and accurately without having to cut or measure material.

The above-described building system, as well as the previously described panel system, are applicable to other frame construction industries including, but not limited to, mobile homes, recreational vehicles and industrial housing.

The longitudinal members in this building system, as well as in the previously described panel system, may have holes pre-cut therein, where appropriate, for fire sprinklers, plumbing and wiring applications.

As with the panel building system, the present building system may additionally include the aforementioned key block members, filler members and corner/connecting blocks to facilitate the construction of various structures conventional in the building trades.

Additionally, the aforedescribed building system and panel building system can be used in conjuction with one another thereby allowing customized building with standardized elements. Alternatively, the use of the systems in conjunction allows for construction of a structure at one stage and expansion or modification of the structure at a later stage, e.g., a "starter" home with provisions for expansion of the home as family size increases or economics allow.

Moreover, the use of standardized elements (panel structures, longitudinal members, transverse members, key block members, filler block members, corner/connecting blocks, etc.) allows the use of pre-set plans, tight control of materials of construction (minimum waste) and tight control (and prediction) of costs of construction.

In another embodiment the present invention provides a toy construction set comprising a plurality of plastic pieces adapted to be glued together to form generally rectangular structures. In particular, the toy construction set provides predetermined numbers of each of the structural elements previously described, i.e. longitudinal members, transverse members, key block members, filler blocks and corner/connecting blocks formed of extruded plastic in a miniaturized format. In this regard, the construction set would mimic actual building construction sizes and standards but on about ¼-1/25 scale. For instance, a standard 2"×4"×8' longitudinal member used in the construction industry would appear at 1/10 scale as about a 0.2"×0.4"×0.8' member in the toy construction set. Suitable glue for bonding the pieces together may be provided in the set, as well as instructions for various building projects. Additionally, sheets of material, which can be cut to size, can be provided to mimic interior and exterior finishing of frame building construction. Such material may be of paper, plastic or cloth and may be finished in a pattern to mimic known construction materials, e.g., shingles and clapboard for exterior finishing, dry wall and flooring for interior finishing.

Additionally, such a toy construction set can be utilized as a planning tool in the design of actual structures to be built or in marketing presentations to potential customers.

What is claimed is:

1. A wooden construction element having a predetermined length and having a cross-sectional profile comprising a first flange portion having a predetermined thickness and width, a second flange portion having a predetermined thickness and width, said first and second flange portions being parallel to one another relative to their thickness dimension and interconnected by a central integral web portion of predetermined width and essentially smaller thickness than said flange portions.

2. The wooden construction element according to claim 1, wherein said central integral web portion comprises a uniform thickness section having a thickness less than that of said flanges, a first transition section connecting said first flange portion and said uniform thickness section having a thickness tapering from that of said first flange portion to that of said uniform thickness section, and second transition section connecting said second flange portion and said uniform thickness section having a thickness tapering from that of said second flange portion to that of said uniform thickness section.

3. The wooden construction element according to claim 1, wherein said first flange portion and said second flange portion are essentially identical in thickness and width.

4. The wooden construction element according to claim 3, wherein the overall thickness of said element is not more than 2 inches.

5. The wooden construction element according to claim 4, wherein the overall width of said element is not more than 12 inches.

6. The wooden construction element according to claim 5, wherein said overall width is not more than 4 inches.

7. A construction element having a predetermined length and having a cross-sectional profile comprising a first flange portion and a second flange portion, said first and second flange portions being of essentially identical predetermined thickness and essentially identical predetermined width, said first and second flange portions being parallel to one another relative to their thickness dimension and interconnected by a central integral web portion of predetermined width and of a thickness about one third of that of said flange portions, said width of said web portion being about equal to the sum of the widths of said flange portions.

8. The construction element according to claim 7, wherein the overall thickness of said element is not more than 2 inches.

9. The construction element according to claim 8, wherein the overall width of said element is not more than 12 inches.

10. The construction element according to claim 9, wherein said overall width is not more than 4 inches.

11. A construction element having a predetermined length and having a cross-sectional profile comprising a first flange portion and a second flange portion, said first and second flange portions being of essentially identical predetermined thickness and essentially identical predetermined width, said first and second flange portions being parallel to one another relative to their thickness dimension and interconnected by a central integral web portion comprising a uniform thickness section having a predetermined width and a thickness about one third of that of said flange portions, a first transition section having a width about equal to that of said first flange portion and connecting said first flange portion and said uniform thickness section and having a thickness tapering from that of said first flange portion to that of said uniform thickness section, and a second transition section having a width about equal to that of said second flange portion and connecting said second flange portion and said uniform thickness section and having a thickness tapering from that of said second flange portion to that of said uniform thickness section, said predetermined width of said uniform thickness section being about equal to three times the width of one of said flange portions.

12. The construction element according to claim 11, wherein the overall thickness of said element is not more than 2 inches.

13. The construction element according to claim 12, wherein the overall width of said element is not more than 12 inches.

14. The construction element according to claim 13, wherein said overall width is not more than 4 inches.

* * * * *